US009136081B2

(12) United States Patent
Leung et al.

(10) Patent No.: US 9,136,081 B2
(45) Date of Patent: Sep. 15, 2015

(54) D/C TRIP ASSEMBLY

(71) Applicant: Eaton Corporation, Cleveland, OH (US)

(72) Inventors: Kin Hang Leung, Greenbelt, MD (US); James Patrick Sisley, Baden, PA (US); David Curtis Turner, Imperial, PA (US); David Edward Little, Midland, PA (US); Paul Alan Merck, Crescent Township, PA (US)

(73) Assignee: EATON CORPORATION, Cleveland, OH (US)

( * ) Notice: Subject to any disclaimer, the term of this patent is extended or adjusted under 35 U.S.C. 154(b) by 166 days.

(21) Appl. No.: 14/133,691

(22) Filed: Dec. 19, 2013

(65) Prior Publication Data

US 2015/0179380 A1 Jun. 25, 2015

(51) Int. Cl.

| | |
|---|---|
| ***H01H 71/24*** | (2006.01) |
| ***H01H 50/18*** | (2006.01) |
| ***H01H 50/64*** | (2006.01) |
| ***H01H 71/32*** | (2006.01) |

(52) U.S. Cl.

CPC ..... *H01H 71/24* (2013.01); *H01H 50/18* (2013.01); *H01H 50/643* (2013.01); *H01H 71/2472* (2013.01); *H01H 71/32* (2013.01); *H01H 71/327* (2013.01)

(58) Field of Classification Search

CPC ..... H01H 71/24; H01H 50/643; H01H 50/18

See application file for complete search history.

(56) References Cited

U.S. PATENT DOCUMENTS 3,773,992 A 11/1973 Mune
4,739,291 A * 4/1988 Lee ..... 335/17

FOREIGN PATENT DOCUMENTS

| | | | |
|---|---|---|---|
| DE | 1220014 B | * | 6/1966 |
| FR | 1531609 A | * | 7/1968 |
| GB | 191515633 A | * | 10/1916 |
| GB | 112983 A | * | 2/1918 |
| GB | 996 014 A | | 6/1965 |

OTHER PUBLICATIONS

European Patent Office, "International Search Report and Written Opinion", Feb. 13, 2015, 9 pp.

* cited by examiner

*Primary Examiner* — Mohamad Musleh
(74) *Attorney, Agent, or Firm* — Eckert Seamans Cherin & Mellott, LLC; David C. Jenkins

(57) ABSTRACT

A D/C trip assembly for a circuit breaker is provided. The D/C trip assembly includes a magnet, a mounting assembly and an armature assembly. The mounting assembly includes a body, the mounting assembly body including a pivotal coupling. The armature assembly includes a magnetic body and a trip bar linkage, the trip bar linkage extending from the armature assembly body. The armature assembly body is structured to move between a first position, wherein the armature assembly body is close to the magnet, and a second position, wherein the armature assembly body is spaced from the magnet. The trip bar linkage is structured to move between a first position and a second position, the trip bar linkage positions corresponding to the armature assembly body positions. The trip bar linkage is structured to be coupled to a trip bar.

18 Claims, 6 Drawing Sheets

D/C TRIP ASSEMBLY

BACKGROUND OF THE INVENTION

1. Field of the Invention

The disclosed and claimed concept relates to a circuit breaker and, more specifically, to a magnetic D/C trip assembly that is replaces an A/C trip assembly.

2. Background Information

Circuit breakers are well known in the art. A circuit breaker includes a trip unit assembly that is, generally, structured to detect an over-current condition in one of an A/C current or a D/C current. Thus, a circuit breaker having a trip unit only structured to detect an A/C over-current condition cannot detect a D/C over-current condition. There is, therefore, a need for a D/C trip assembly structured to replace an A/C trip assembly. There is a further need for the D/C trip assembly to be incorporated into existing A/C only circuit breakers.

SUMMARY OF THE INVENTION

These needs, and others, are met by at least one embodiment of the disclosed and claimed concept which provides a magnetic D/C trip assembly structured to replace an A/C trip assembly in a circuit breaker. The circuit breaker includes a housing assembly, a trip unit with an A/C trip assembly, and a conductor assembly. The conductor assembly includes a number of load buses and the trip unit includes a trip bar. The D/C trip assembly includes a magnet and mounting assembly and an armature assembly. The mounting assembly includes a body, wherein the mounting assembly body includes a pivotal coupling. The mounting assembly body is structured to be coupled to the circuit breaker housing assembly and to position the mounting assembly body pivotal coupling adjacent the magnet. The armature assembly includes a magnetic body and a trip bar linkage, the trip bar linkage extending from the armature assembly body. The armature assembly body is pivotally coupled to the mounting assembly body pivotal coupling. The armature assembly body is structured to move between a first position, wherein the armature assembly body is close to the magnet, and a second position, wherein the armature assembly body is spaced from the magnet. The trip bar linkage is structured to move between a first position and a second position, the trip bar linkage positions corresponding to the armature assembly body positions. The trip bar linkage is structured to be coupled to the trip bar.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
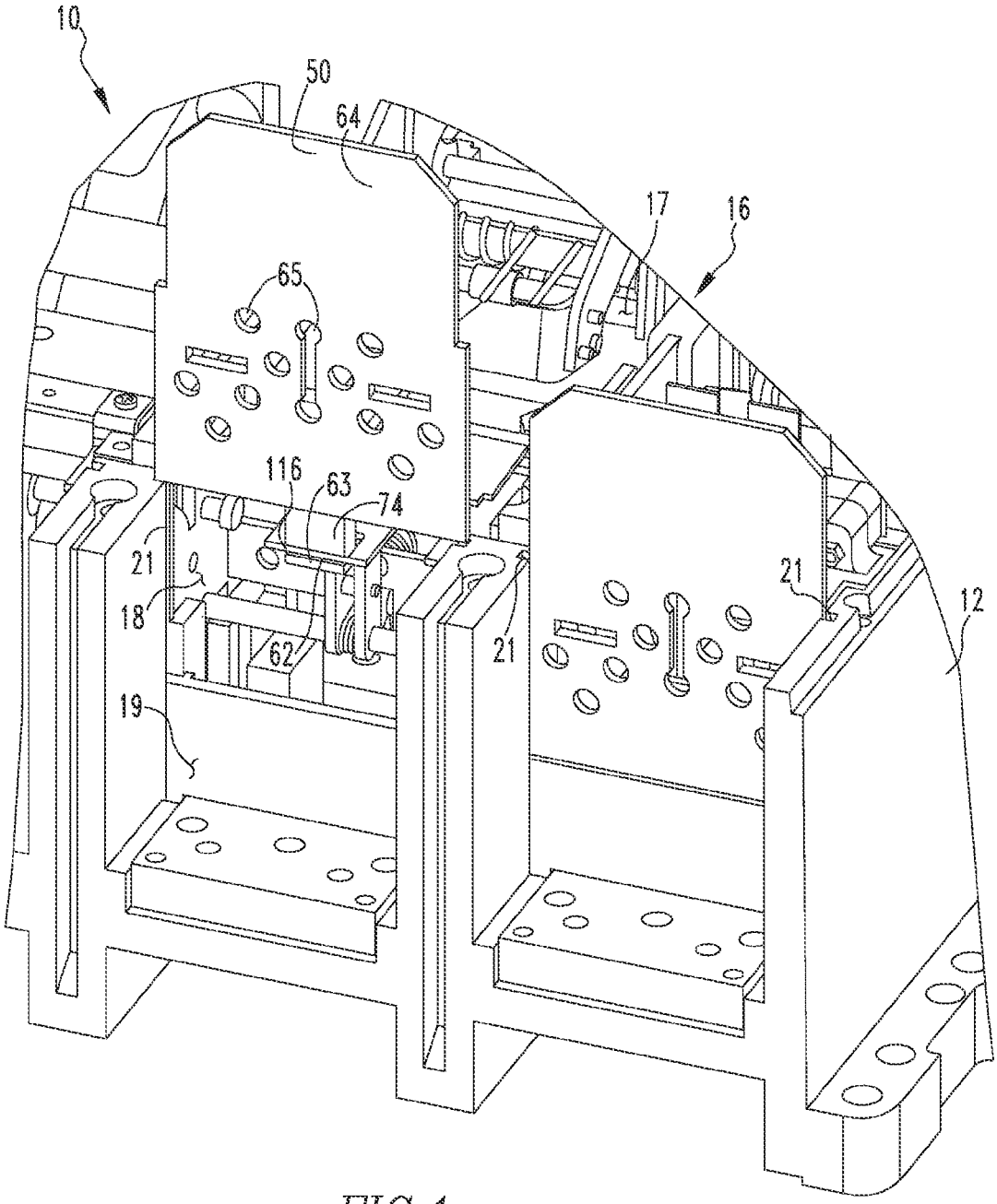
FIG. 1 is a partial isometric view of a circuit breaker.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, the statement that two or more parts or components "engage" one another shall mean that the parts exert a force against one another either directly or through one or more intermediate parts or components.

As used herein, the word "unitary" means a component is created as a single piece or unit. That is, a component that includes pieces that are created separately and then coupled together as a unit is not a "unitary" component or body.

As used herein, the term "number" shall mean one or an integer greater than one (i.e., a plurality).

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, a "magnetic element" or "magnetic body" is either a member that is attracted to materials such as iron or steel, e.g., a typical magnet, or a member of iron or steel, or a similar material, to which a magnet is attracted.

As used herein, a magnet "operatively spaced" from another element capable of magnetic attraction means that the two elements are so close as to allow the magnet to be attracted to the other element with a sufficient force so that, if the magnet or other element is not restrained, the magnet or other element would move into contact with each other.

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening are made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit.

As shown in FIG. 1, and as is known, a circuit breaker 10 includes a housing assembly 12, a conductor assembly 14, an operating mechanism 16, a trip unit assembly 40, (some elements shown schematically or in part) as well as other components. The housing assembly 12 is made from a non-conductive material and defines an enclosed space 18 wherein the other components may be disposed. The housing assembly enclosed space 18 is, in an exemplary embodiment, divided into a number of cavities 17 including a number of elongated channels 19 and a trip unit cavity (not shown).

Figure 2:
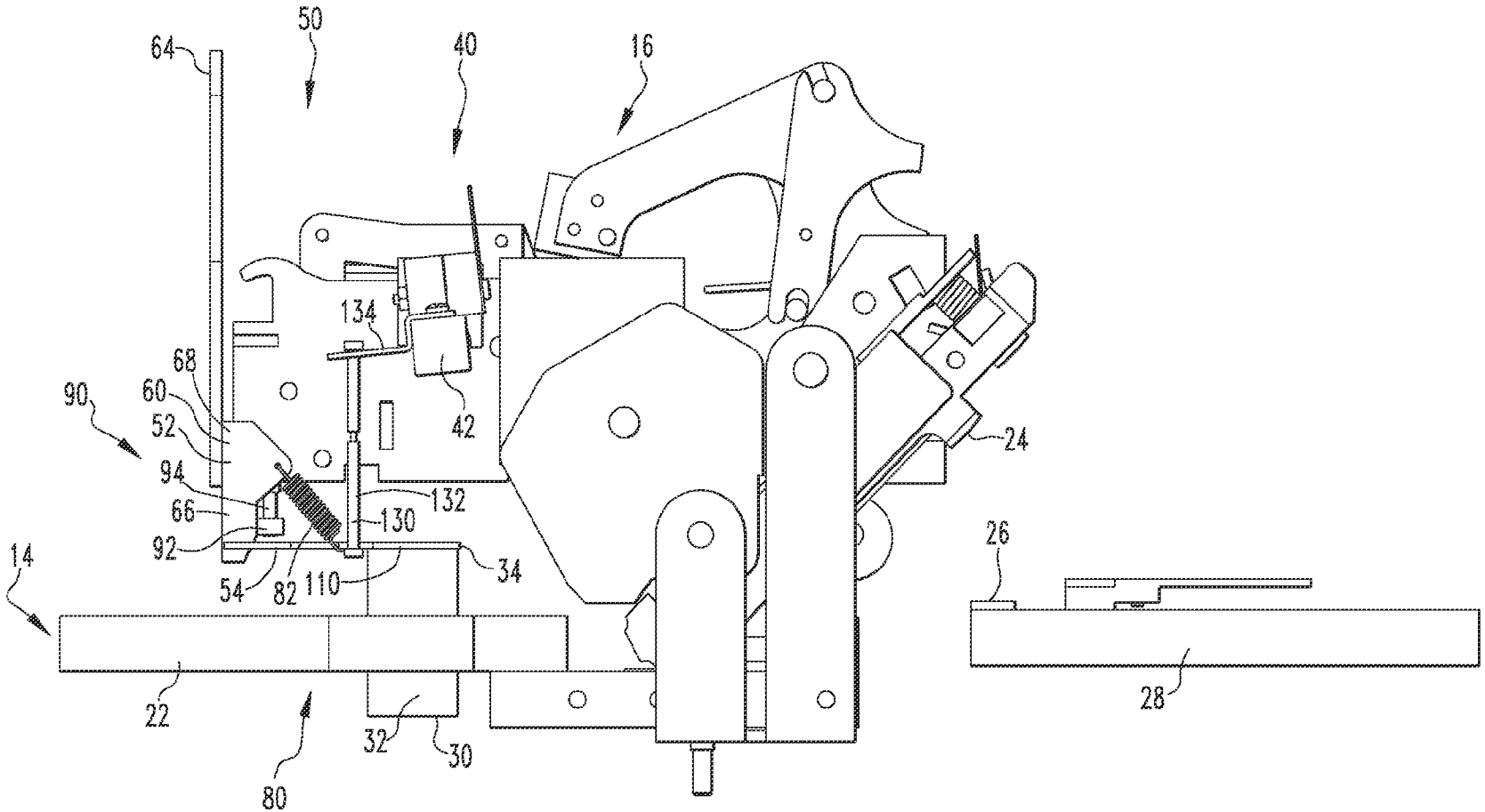
FIG. 2 is a side view of a circuit breaker, without a housing assembly, in a first position.
Figure 3:
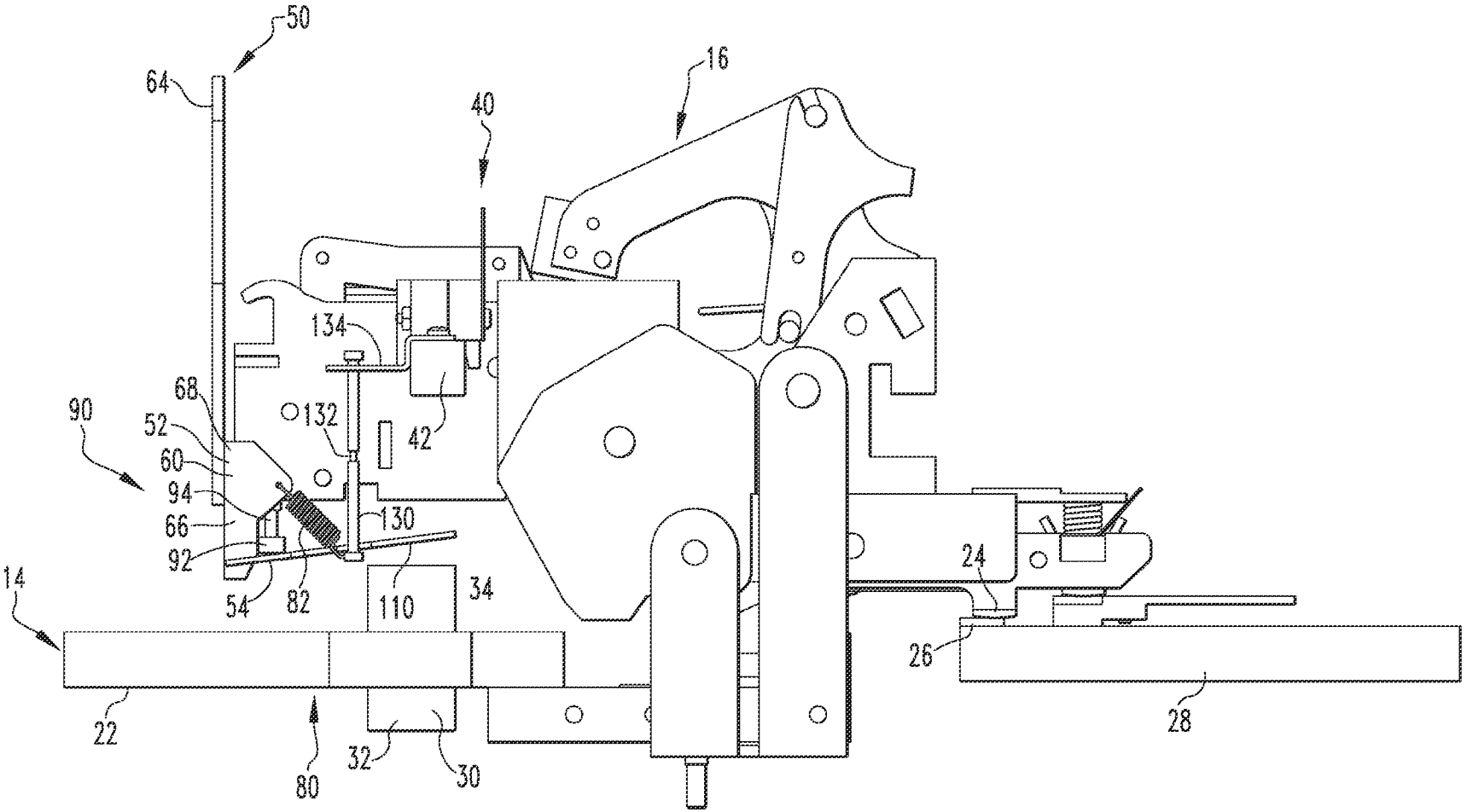
FIG. 3 is a side view of a circuit breaker, without a housing assembly, in a second position.

That is, as shown in FIGS. 2 and 3, each conductor assembly 14 includes, but is not limited to, a load bus 22, a movable contact 24, a fixed contact 26, and a line bus 28. The load bus 22 and movable contact 24 are in electrical communication. The fixed contact 26 and the line bus 28 are in electrical communication. The operating mechanism 16 is coupled to each movable contact 24 and is structured to move each movable contact 24 between an open, first position, wherein each movable contact 24 is spaced from an associated fixed contact 26, and, a closed, second position, wherein each movable contact 24 is directly coupled to, and in electrical communication with, the associated fixed contact 26. Further, the load bus 22 includes an electro-magnet 30 (hereinafter "magnet 30"). It is understood that when current passes through load bus 22, the magnet 30 generates a magnetic field. In an exemplary embodiment, the magnet 30 is spaced from the movable contact 24. Also, in an exemplary embodiment, the magnet 30 includes a generally cylindrical body 32 with a generally planar upper side 34. The magnet 30 is also part of the D/C trip assembly 50, described below. As is known, the circuit breaker 10, in an exemplary embodiment, includes multiple conductor assemblies 14. Further, each conductor assembly 14 is disposed in a housing assembly channel 19 and substantially separated from the adjacent conductor assemblies 14.

The operating mechanism 16 includes biasing elements (not shown), such as but not limited to, springs (not shown), that bias the contacts 24, 26 to the open, first position. The operating mechanism 16 includes a handle (not shown) that is used to move the contacts 24, 26 into the closed second position. The operating mechanism 16 further includes a catch (not shown), or similar device, that maintains the contacts 24, 26 in the second position. The catch, or more generally the operating mechanism 16 is mechanically coupled to the trip unit assembly 40. In an exemplary embodiment, a first trip assembly (not shown) is structured to detect an over-current condition in an A/C circuit, (hereinafter "A/C trip assembly"). As is known, when the A/C trip assembly detects an over-current condition, a mechanical linkage, such as but not limited to a trip bar 42, coupled to the operating mechanism 16, causes the catch to be released thereby causing the bias of the operating mechanism 16 to move the contacts 24, 26 to the open, first position. That is, the trip unit assembly 40 includes a trip bar 42 that moves between a first position, wherein the trip bar 42 does not restrain the operating mechanism 16, and a second position, wherein the trip bar 42 restrains the operating mechanism 16. As is further known, the operating mechanism 16 can also be moved into a "reset" configuration.

Figure 4:
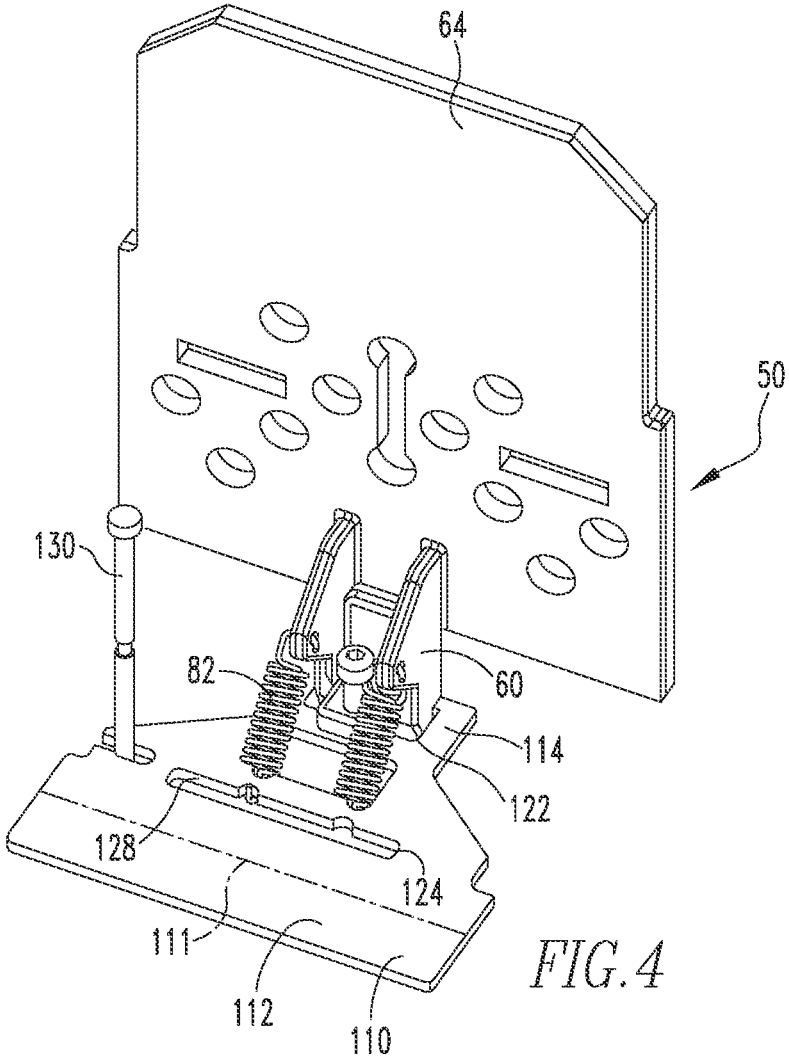
FIG. 4 is an isometric view of a D/C trip assembly.
Figure 6:
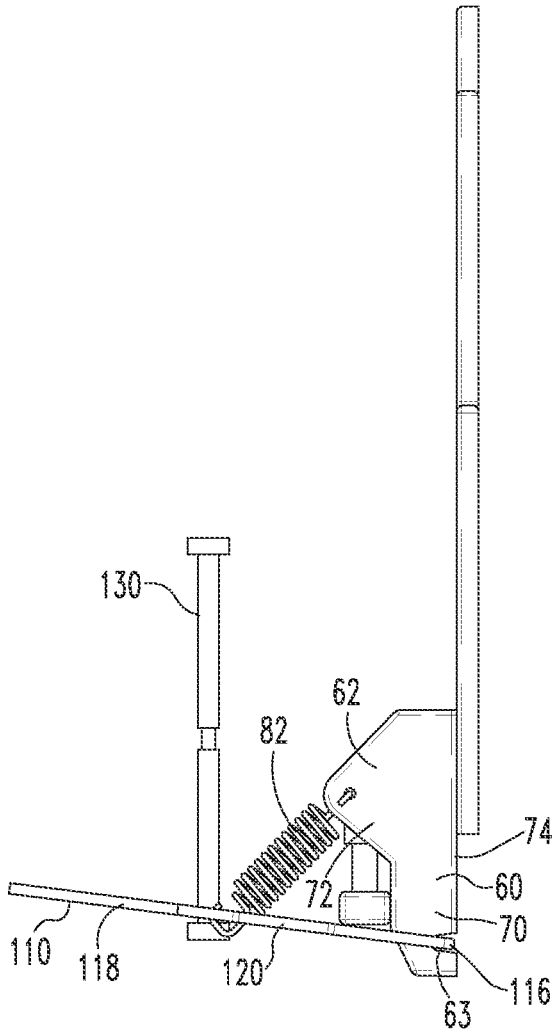
FIG. 6 is a side view of a D/C trip assembly.

In an exemplary embodiment, elements of the A/C trip unit are replaced by a D/C magnetic trip armature assembly 50 (hereinafter "D/C trip assembly 50"). That is, each conductor assembly 14 includes a D/C trip assembly 50, as shown in FIGS. 4 and 6. Each D/C trip assembly 50 is structured to detect a D/C trip condition. Thus, the D/C trip assembly 50 replaces an A/C trip assembly (not shown). The D/C trip assembly 50 includes a magnet 30 (described above), a mounting assembly 52 and an armature assembly 54. The mounting assembly 52 includes a body 60, a biasing assembly 80, and a calibration assembly 90.

Figure 5:
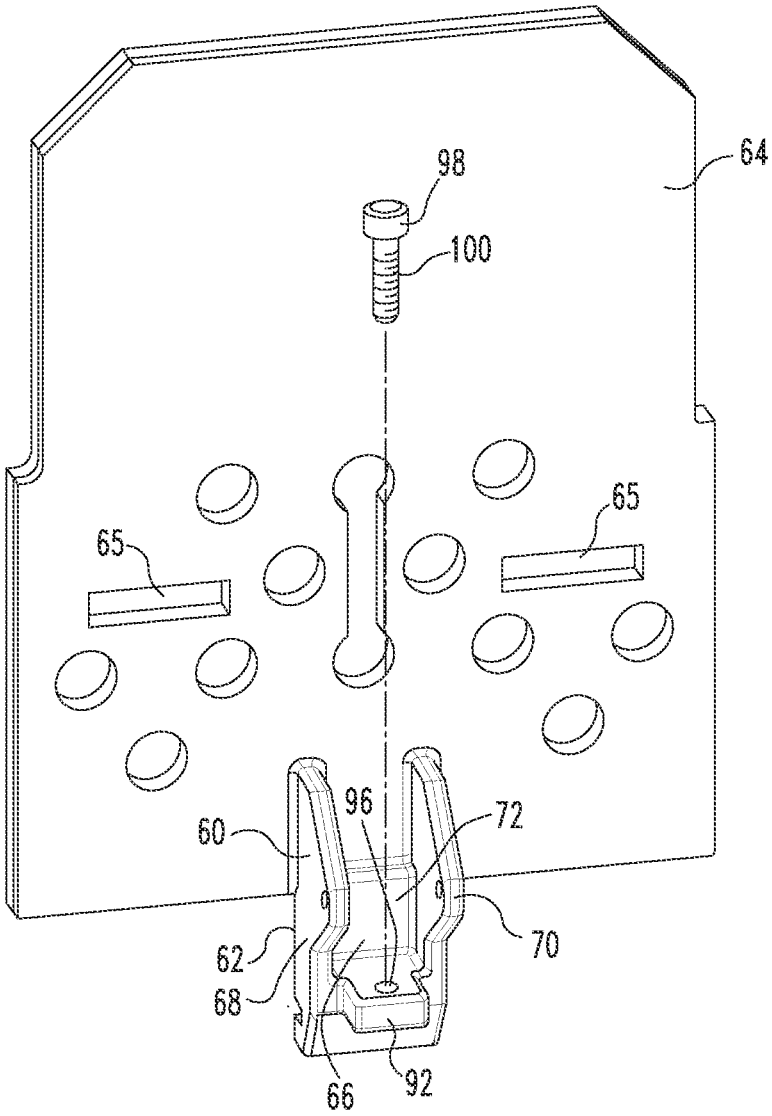
FIG. 5 is an isometric view of a D/C trip assembly mounting assembly.

The mounting assembly body 60, as shown in FIG. 5, is structured to be coupled to the circuit breaker housing assembly 12. The mounting assembly body 60 includes a pivotal coupling 62 and a barrier member 64. In an exemplary embodiment, the mounting assembly body 60 includes a generally planar base member 66 and two generally planar side members 68, 70. The side members 68, 70 extend from the lateral sides of, and generally perpendicular to, the planar base member 66. Thus, the mounting assembly body 60 has a generally U-shaped cross section. The mounting assembly body 60 has a front side 72, which is the side that the side members 68, 70 extend toward, and a back side 74, which is generally planar. In an exemplary embodiment, the pivotal coupling 62 is a groove 63 extending laterally across the mounting assembly body back side 74. The pivotal coupling 62 has a plane of motion which, in an exemplary embodiment, is generally parallel to the plane of the side members 68, 70.

The barrier member 64 is a generally planar member having a width corresponding to a circuit breaker housing assembly channel 19. That is, the barrier member 64 is generally as wide as a circuit breaker housing assembly channel 19. The barrier member 64 includes a number of vent passages 65. The barrier member 64 is structured to be coupled to the circuit breaker housing assembly 12 within a circuit breaker housing assembly channel 19 and to position the mounting assembly body 60 pivotal coupling 62 adjacent a conductor assembly 14, and, in an exemplary embodiment, adjacent a magnet 30. In an exemplary embodiment, each circuit breaker housing assembly channel 19 includes two opposing grooves 21 (FIG. 1) and the barrier member 64 is sized to correspond thereto. In this configuration, the mounting assembly body 60 may be coupled to the circuit breaker housing assembly 12 by sliding the barrier member 64 into the grooves 21.

As shown in FIGS. 2 and 3, the biasing assembly 80, in an exemplary embodiment, includes a number of springs 82. As shown, in an exemplary embodiment, there are two springs 82 each of which are coupled, or directly coupled, to a mounting assembly body side member 68, 70. The springs 82 are further coupled to the armature assembly body 110, described below, and bias the armature assembly body 110 toward the mounting assembly body 60.

The calibration assembly 90, in an exemplary embodiment, includes a calibration block 92 and a calibration member 94. In an exemplary embodiment, the calibration block 92 is coupled to the mounting assembly body 60 adjacent the mounting assembly body pivotal coupling 62. In another exemplary embodiment, as shown, the calibration block 92 is unitary with the mounting assembly body 60. As shown, the calibration block 92 is disposed on the mounting assembly body front side 72 between the mounting assembly body side member 68, 70. The calibration block 92 includes a threaded passage 96. The calibration assembly threaded passage 96 extends in, or parallel to, the mounting assembly body pivotal coupling 62 plane of motion. The calibration member 94 includes an elongated body 98 with a threaded portion 100. The calibration member 94 is threadably coupled to said calibration block 92.

The armature assembly 54 includes a body 110 and a trip bar linkage 130. In an exemplary embodiment, the armature assembly body 110 is generally planar and includes an elongated rectangular portion 112 and a coupling portion 114. The rectangular portion 112 is a magnetic body. The rectangular portion 112 has a longitudinal axis that extends generally perpendicular to the mounting assembly body pivotal coupling plane of motion. In an exemplary embodiment, the coupling portion 114 extends from, or is unitary with, the rectangular portion 112. The coupling portion 114 includes a pivot rod 116, a biasing device coupling 118, and a calibration device coupling 120.

In an exemplary embodiment, the coupling portion 114 is generally planar and disposed in generally the same plane as the rectangular portion 112. Further, the coupling portion 114 is tapered, or has a tapered portion as shown, from a wide end, adjacent the rectangular portion 112, to a narrow end at the pivot rod 116. The armature assembly pivot rod 116 is sized to correspond to the pivotal coupling groove 63. That is, the armature assembly pivot rod 116 is structured to be pivotally coupled to the pivotal coupling groove 63. Adjacent the armature assembly pivot rod 116 is a passage 122 sized to correspond to the mounting assembly body 60. The coupling portion 114, as shown, includes additional passages 124.

The biasing device coupling 118 is structured to be coupled to the biasing assembly 80. In an exemplary embodiment, wherein the biasing assembly 80 includes springs 82, the biasing device coupling 118 is structured to be coupled to the springs 82. As shown, the biasing device coupling 118 is a thin, elongated brace 128 defined by additional passages 124.

The calibration device coupling 120 is a planar portion of the coupling portion 114 disposed adjacent the calibration block 92. The calibration device coupling 120 provides a surface for the calibration member 94 to engage.

The trip bar linkage 130 is, in an exemplary embodiment, a rigid linkage structured to be coupled to the trip bar 42. As shown, and in an exemplary embodiment, the trip bar linkage 130 includes an elongated rod 132 and a bracket 134. The trip bar linkage rod 132 extends generally normal to the generally planar armature assembly body 110. The trip bar linkage bracket 134 is coupled to both, and extends between, the trip bar linkage rod 132 and the trip bar 42.

The D/C trip assembly 50 is assembled as follows. The armature assembly body 110 is pivotally coupled to the mounting assembly body pivotal coupling 62. That is, in an exemplary embodiment, the armature assembly pivot rod 116 is pivotally coupled to the pivotal coupling groove 63. The mounting assembly body 60 is disposed in the armature assembly coupling portion passage 122 with the calibration device coupling 120 disposed adjacent the calibration block 92. The calibration member 94 is threaded through the calibration block 92 and the lower end thereof is positioned immediately adjacent the calibration device coupling 120. The biasing assembly 80 is coupled to the armature assembly body 110. That is, in an exemplary embodiment, the biasing assembly springs 82 are coupled to, and extend between, the mounting assembly body 60 and the biasing device coupling brace 128.

The barrier member 64 is then coupled to the circuit breaker housing assembly 12. In an exemplary embodiment, the barrier member 64 is coupled to circuit breaker housing assembly opposing grooves 21 within a circuit breaker housing assembly channel 19. The trip bar linkage 130 is coupled to the trip bar 42, for example, by fasteners, not shown.

In this configuration, the armature assembly body magnetic rectangular portion 112 is disposed adjacent the magnet 30. Further, the armature assembly body 110 is structured to move between a first position, wherein the armature assembly body 110 is close to the magnet 30, and a second position, wherein the armature assembly body 110 is spaced from the magnet 30. It is noted that these positions are relative positions. In an exemplary embodiment, the armature assembly body magnetic rectangular portion 112 is structured to move between a first position, wherein the armature assembly body magnetic rectangular portion 112 is in contact with the magnet 30, and a second position, wherein the armature assembly body magnetic rectangular portion 112 is spaced from the magnet 30.

As is known, the amount of current passing through the conductor assembly 14 affects the strength of the magnetic field in the magnet 30. That is, the stronger the current, the stronger the magnetic field. When the armature assembly body 110 is in the second position, which is its position during normal operation of the circuit breaker 10, the armature assembly body 110, and more specifically the armature assembly body magnetic rectangular portion 112, is operatively spaced from the magnet 30. The armature assembly body 110 is, however, maintained in the second position by the strength of the biasing assembly 80. Thus, during normal operation, i.e. when there is not an over-current condition, the armature assembly body 110 is not drawn toward the magnet 30.

When an over-current condition occurs, the strength of the magnetic field generated by the magnet 30 increases. When the strength of the magnetic field generated by the magnet 30 increases, the strength of the magnetic field overcomes the bias created by the biasing assembly 80 and the armature assembly body 110 is drawn toward the conductor assembly 14, and more specifically to the magnet 30. The motion of the armature assembly body 110 causes the trip bar linkage 130 to move as well and causes the trip bar 42 to rotate. As is known, movement of the trip bar 42 causes the trip unit assembly 40 to release the operating mechanism 16 and move the contacts 24, 26 to the first position. Thus, the trip bar linkage 130 also moves between a first position and a second position. Further, the positions of the armature assembly body 110, the trip bar linkage 130, the trip bar 42, and contacts 24, 26 correspond to each other. That is, when the armature assembly body 110 is in the second position, the trip bar linkage 130 and the trip bar 42 are in their second positions, thereby allowing the operating mechanism 16 to maintain the contacts 24, 26 in their second position. Following an over-current condition, the armature assembly body 110 moves to the first position which in turn moves the trip bar linkage 130 and the trip bar 42 to their first positions which releases the operating mechanism 16 causing the contacts 24, 26 to move into their first position.

The calibration assembly 90 is structured to alter the location of the armature assembly body 110 second position. That is, calibration assembly 90 allows the armature assembly body 110, while in the second position, to be moved slightly closer to, or further from, the magnet 30. For example, by moving the calibration member 94 toward the armature assembly body 110, the calibration member 94 contacts the calibration device coupling 120 at a lower (as shown) location, thus positioning the armature assembly body 110 at a slightly lower position than if the calibration member 94 was not present. Thus, the calibration assembly 90 allows the armature assembly body 110, while in the second position, to be moved between an upper second position and a lower second position. Stated alternately, when the armature assembly body 110 is in said second position, the calibration assembly 90 is structured to position the armature assembly body 110 in one of a number of calibrated positions, the armature assembly body 110 calibrated positions disposed between an upper second position and a lower second position.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A D/C trip assembly structured to detect a D/C trip condition in an A/C circuit breaker, wherein said circuit breaker includes a housing assembly, a trip unit assembly, and a conductor assembly, said conductor assembly including a number of load buses, said trip unit assembly including a trip bar, said D/C trip assembly comprising:

a magnet coupled to a load bus;

a mounting assembly including a body, said mounting assembly body including a pivotal coupling;

said mounting assembly body structured to be coupled to said circuit breaker housing assembly and to position said mounting assembly body pivotal coupling adjacent said magnet;

an armature assembly including a magnetic body and a trip bar linkage, said trip bar linkage extending from said armature assembly body;

said armature assembly body pivotally coupled to said mounting assembly body pivotal coupling;

said armature assembly body structured to move between a first position, wherein said armature assembly body is close to said magnet, and a second position, wherein said armature assembly body is spaced from said magnet;

wherein, said trip bar linkage structured to move between a first position and a second position, said trip bar linkage positions corresponding to said armature assembly body positions; and said trip bar linkage structured to be coupled to said trip bar.

2. The D/C trip assembly of claim 1 wherein:

said mounting assembly body pivotal coupling has a plane of motion;

said armature assembly body includes an elongated rectangular portion having a longitudinal axis; and said armature assembly body planar portion longitudinal axis extending generally perpendicular to said mounting assembly body pivotal coupling plane of motion.

3. The D/C trip assembly of claim 1 wherein:

said mounting assembly includes a biasing assembly;

said biasing assembly coupled to said armature assembly body; and said biasing assembly biasing said armature assembly body to said second position.

4. The D/C trip assembly of claim 3 wherein said biasing assembly includes a number of springs.

5. The D/C trip assembly of claim 1 wherein:

said mounting assembly includes a calibration assembly; and wherein, when said armature assembly body is in said second position, said calibration assembly is structured to position said armature assembly body in one of a number of calibrated positions, said armature assembly body calibrated positions disposed between an upper second position and a lower second position.

6. The D/C trip assembly of claim 5 wherein:

said calibration assembly includes a calibration block and a calibration member;

said calibration block coupled to said mounting assembly body adjacent said mounting assembly body pivotal coupling;

said calibration block including a threaded passage;

said calibration member including an elongated body with a threaded portion; and said calibration member threadably coupled to said calibration block.

7. The D/C trip assembly of claim 1 wherein said circuit breaker housing assembly defines a number of channels, each channel having a width, and wherein:

said mounting assembly body includes a barrier member;

wherein said barrier member is a planar member having a width corresponding to a circuit breaker housing assembly channel; and said barrier member structured to be coupled to said circuit breaker housing assembly within a circuit breaker housing assembly channel.

8. The D/C trip assembly of claim 7 wherein said barrier member includes a number of vent passages.

9. The D/C trip assembly of claim 1 wherein:

said mounting assembly body includes a barrier member and a calibration block; and wherein said mounting assembly body pivotal coupling, barrier member and a calibration block are unitary.

10. A circuit breaker comprising:

a housing assembly, a trip unit assembly, a conductor assembly, and a D/C trip assembly;

said housing assembly defining a number of channels;

said conductor assembly including a number of load buses;

each said load bus disposed in one said channel;

said trip unit assembly including a trip bar;

said D/C trip assembly including a magnet, a mounting assembly and an armature assembly;

said magnet coupled to a load bus;

said mounting assembly including a body, said mounting assembly body including a pivotal coupling;

said mounting assembly body coupled to said circuit breaker housing assembly and to position said mounting assembly body pivotal coupling adjacent said conductor assembly;

said armature assembly including a magnetic body and a trip bar linkage, said trip bar linkage extending from said armature assembly body;

said armature assembly body pivotally coupled to said mounting assembly body pivotal coupling;

said armature assembly body structured to move between a first position, wherein said armature assembly body is close to said magnet, and a second position, wherein said armature assembly body is spaced from said magnet;

wherein, said trip bar linkage structured to move between a first position and a second position, said trip bar linkage positions corresponding to said armature assembly body positions; and said trip bar linkage coupled to said trip bar.

11. The circuit breaker of claim 10 wherein:

said mounting assembly body pivotal coupling has a plane of motion;

said armature assembly body includes an elongated rectangular portion having a longitudinal axis; and said armature assembly body planar portion longitudinal axis extending generally perpendicular to said mounting assembly body pivotal coupling plane of motion.

12. The circuit breaker of claim 10 wherein:

said mounting assembly includes a biasing assembly;

said biasing assembly coupled to said armature assembly body; and said biasing assembly biasing said armature assembly body to said second position.

13. The circuit breaker of claim 12 wherein said biasing assembly includes a number of springs.

14. The circuit breaker of claim 10 wherein:

said mounting assembly includes a calibration assembly; and wherein, when said armature assembly body is in said second position, said calibration assembly is structured to position said armature assembly body in one of a number of calibrated positions, said armature assembly body calibrated positions disposed between an upper second position and a lower second position.

15. The circuit breaker of claim 14 wherein:

said calibration assembly includes a calibration block and a calibration member;

said calibration block coupled to said mounting assembly body adjacent said mounting assembly body pivotal coupling;

said calibration block including a threaded passage;

said calibration member including an elongated body with a threaded portion; and said calibration member threadably coupled to said calibration block.

16. The circuit breaker of claim 1 wherein:

each housing assembly channel has a width;

said mounting assembly body includes a barrier member;

wherein said barrier member is a planar member having a width corresponding to a circuit breaker housing assembly channel; and said barrier member structured to be coupled to said circuit breaker housing assembly within a circuit breaker housing assembly channel.

17. The circuit breaker of claim 16 wherein said barrier member includes a number of vent passages.

18. The circuit breaker of claim 10 wherein:

said mounting assembly body includes a barrier member and a calibration block; and wherein said mounting assembly body pivotal coupling, barrier member and a calibration block are unitary.

* * * * *